United States Patent [19]

Pineda

[11] Patent Number: 4,890,705

[45] Date of Patent: Jan. 2, 1990

[54] PORTABLE FILE WITH RETRACTING HANDLE

[76] Inventor: Jose J. Pineda, P.O. Box 942, Kingston, Tenn. 37763-0942

[21] Appl. No.: 204,887

[22] Filed: Jun. 10, 1988

[51] Int. Cl.[4] ..... A45C 5/00; A45C 13/00

[52] U.S. Cl. ..... 190/18 A; 190/115; 190/109; 190/110

[58] Field of Search ..... 190/109, 110, 900, 18 A, 190/115, 39; 312/244, 320

[56] References Cited

U.S. PATENT DOCUMENTS

| | | | |
|---|---|---|---|
| 294,260 | 2/1884 | Niles | 190/39 |
| 2,185,763 | 1/1940 | DeLisle | 312/320 |
| 2,209,781 | 2/1938 | Lewis | 190/109 |
| 2,661,824 | 8/1950 | Nelson | 190/109 |
| 3,199,643 | 8/1965 | Korchmar | 190/110 |
| 3,988,802 | 11/1976 | Bruni et al. | 312/320 |
| 4,003,611 | 1/1977 | Smith | 312/244 |
| 4,125,303 | 11/1978 | Falkiewicz | 312/244 |
| 4,330,050 | 5/1982 | Sangster et al. | 190/110 |
| 4,358,005 | 11/1982 | Fontana | 190/115 |
| 4,364,150 | 12/1982 | Remington | 190/115 |
| 4,527,677 | 6/1985 | March et al. | 190/110 |
| 4,542,777 | 9/1985 | Benson | 190/109 |
| 4,561,526 | 12/1985 | Winter et al. | 190/18 A |
| 4,588,055 | 5/1986 | Chen | 190/115 |
| 4,793,508 | 12/1988 | Thompson | 190/110 |

FOREIGN PATENT DOCUMENTS

| | | | |
|---|---|---|---|
| 627057 | 12/1981 | Switzerland | 190/900 |

*Primary Examiner*—Stephen Marcus
*Assistant Examiner*—Stephen Castellano
*Attorney, Agent, or Firm*—Jerry T. Kearns

[57] ABSTRACT

A portable file cabinet is constructed as a generally rectangular box having a hinged lid. A pair of multifold file sections are monuted on the interior of the lid. The interior of the file cabinet has a pair of storage compartments and a main record compartment with file dividers. A removable supply case is received within one compartment in the file cabinet. A pair of wheels and a retractable handle are mounted on a bottom surface of the file cabinet to provide ease of transportability. The file cabinet may be constructed from aluminum alloy impregnated with a variety of colors or from a less expensive fiber board material of the type sold under the trademark MASONITE.

12 Claims, 5 Drawing Sheets

PORTABLE FILE WITH RETRACTING HANDLE

BACKGROUND OF THE INVENTION

1.Field of the Invention

The present invention relates to file cabinets, and more particularly pertains to a new and improved portable file cabinet. Travelers such as military personnel, government workers and businessmen are frequently required to carry a relatively large volume of important papers and records. Conventional brief cases and suit cases are inadequate to properly arrange and store these records. Also, these conventional brief cases are not suitable for use as a file cabinet in the home or office of the traveler. In order to overcome these difficulties, the present invention provides a sturdy, easily portable file cabinet with provisions for the organization and storage of a relatively large volume of records. Additionally, the portable file cabinet of the present invention is suitable for use in a home or office environment as well.

2. DESCRIPTION OF THE PRIOR ART

Various types of portable files and record holders are known in the prior art. A typical example of such a record holder is to be found in U.S. Design Pat. No. 132,746, which issued to J. Schenker on June 9, 1942. This patent discloses a binder having a plurality of contiguous multifold record holders which are automatically folded to open positions when the binder is open. U.S. Design Pat. No. 135,393, which issued to I. Weinger et al on Mar. 30, 1943, discloses a portable correspondence file which is constructed as a multifold binder provided with various storage pockets. U.S. Design Pat. No. 162,594, which issued to D. Tames on Mar. 20, 1951, discloses a portable cabinet provided with a plurality of storage compartments. U.S. Design Pat. No. 249,430, which issued to R. Chervenak on Sept. 19, 1978, discloses a cabinet provided with a hinged door. U.S. Design Pat. No. 263,100, which issued to B. Thompson on Feb. 23, 1982, discloses a portable lockable drawer unit having an interior compartment for storage of various items. U.S. Design Pat. 278,957, which issued to R. Flototto on May 28, 1985, discloses an elongated storage cabinet with a plurality of stacked lockable drawers.

While the above mentioned devices are suited for their intended usage, none of these devices provide a portable file cabinet with provisions for the organization and storage of a large volume of records having a bottom surface provided with a pair of wheels and a retractable handle for easy transportability. Inasmuch as the art is relatively crowded with respect to these various types of portable files, it can be appreciated that there is a continuing need for and interest in improvements to such portable files, and in this respect, the present invention addresses this need and interest.

SUMMARY OF THE INVENTION

In view of the foregoing disadvantages inherent in the known types of portable files now present in the prior art, the present invention provides an improved portable file. As such, the general purpose of the present invention, which will be described subsequently in greater detail, is to provide a new and improved portable file which has all the advantages of the prior art portable files and none of the disadvantages.

To attain this, a representative embodiment of the concepts of the present invention is illustrated in the drawings and makes use of a generally rectangular cabinet having a hinged top lid. A pair of multifold files are mounted on the interior of the top lid. The main compartment of the file cabinet is provided with a series of selectively positionable file dividers. A pair of auxiliary compartments are provided for storage of supply materials. A removable supply case is received within one of these compartments for the storage of pens, pencils and other stationery materials. A pair of wheels are mounted on a bottom surface of the cabinet and are utilized in conjunction with a retractable handle to provide portability to the file cabinet.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out it various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable file which has all the advantages of the prior art portable files and none of the disadvantages.

It is another object of the present invention to provide a new and improved portable file which may be easily and efficiently manufactured and marketed.

It is a further object of the present invention to provide a new and improved portable file which is of a durable and reliable construction.

An even further object of the present invention is to provide a new and improved portable file which is susceptible of a low cost of manufacture with regard to both materials and labor, and which accordingly is then susceptible of low prices of sale to the consuming public, thereby making such portable files economically available to the buying public.

Still yet another object of the present invention is to provide a new and improved portable file which provides in the apparatuses and methods of the prior art some of the advantages thereof, while simultaneously overcoming some of the disadvantages normally associated therewith.

Still another object of the present invention is to provide a new and improved portable file cabinet which has provisions for the storage and organization of a large volume of records.

Yet another object of the present invention is to provide a new and improved portable file cabinet which has a pair of wheels and a retractable handle mounted on a bottom surface.

Even still another object of the present invention is to provide a new and improved portable file cabinet which has a hinged top lid provided with a pair of multifold record holders and a main compartment provided with selectively positionable file dividers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
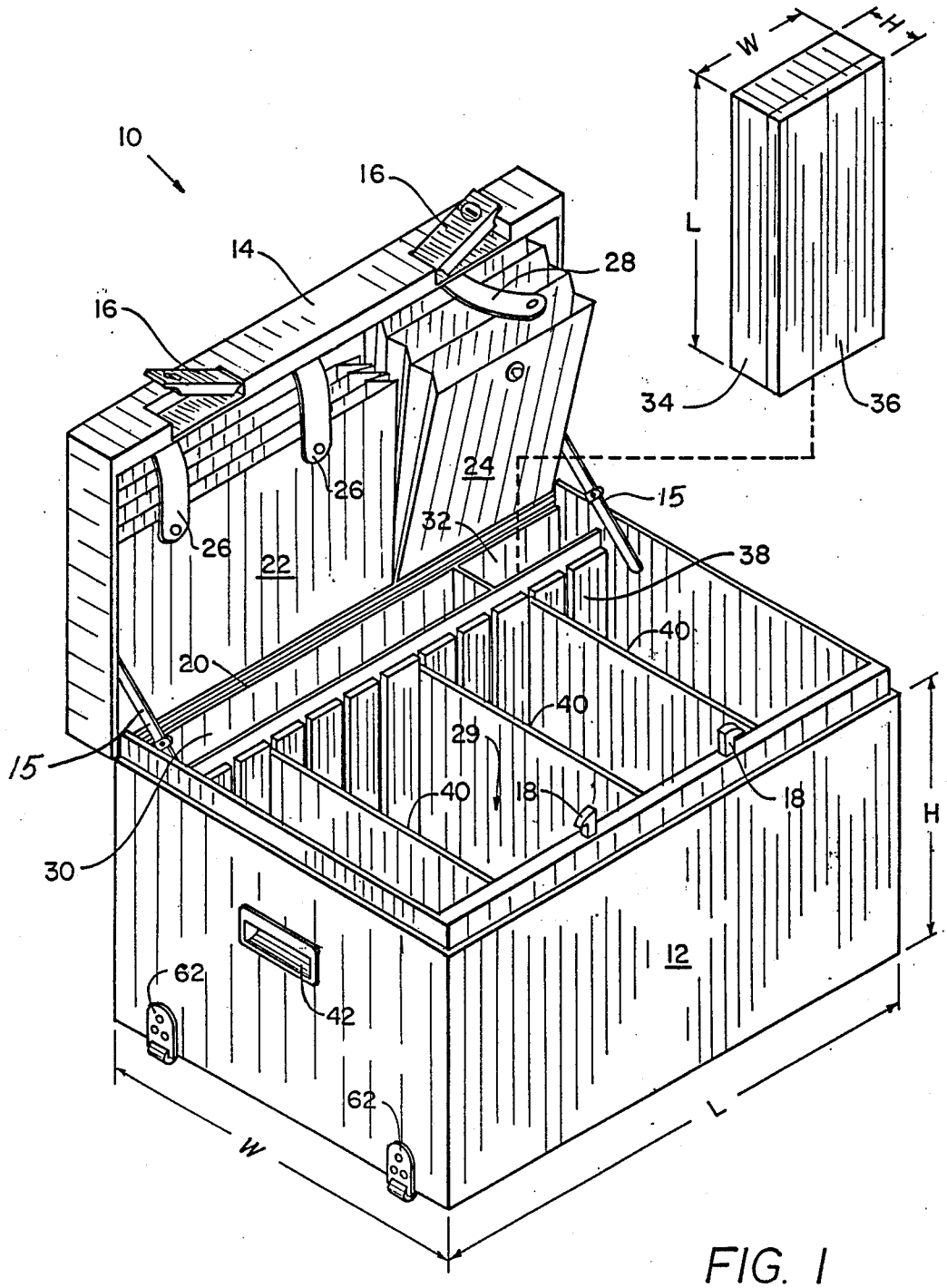
FIG. 1 is a perspective view of the portable file cabinet of the present invention.

With reference now to the draWings, and in particular to FIG. 1 thereof, a new and improved portable file embodying the principles and concepts of the present invention and generally designated by the reference numeral 10 will be described.

More specifically, it will be noted that the first embodiment 10 of the invention includes a generally rectangular hollow file cabinet 12 having a top lid 14. The lid 14 is provided with a key locking pair of conventional suit case type latches 16 for cooperation with catches 18. The lid 14 is movable between the illustrated open position and a closed position by virtue of a hinge 20. A pair of elbow brackets 15 retain the lid in the open position. A pair of multifold file holders 22 and 24 are secured to the inner surface of the lid 14. A pair of snap fastening straps 26 serve to maintain the file holder 22 in a closed position. The file holder 24 is illustrated in an open position with a snap securing strap 28 shown unfastened. The file holders 22 and 24 may be constructed from leather or other flexible durable material. The interior of the generally rectangular file cabinet 12 is divided into three main compartments 29, 30 and 32. A removable supply case 34 is dimensioned to be received within the compartment 32. The supply case 34 typically has a height H of approximately 1.2 inches, a width W of approximately 5.5 inches and a length L of about 12.5 inches. The compartment 32 is correspondingly dimensioned. The file cabinet 12 has a height H of about 14 (inches, a length L of about 24 inches and a W about 17inches. This provides a sufficient space for the storage of a relatively large volume of records, but also makes the file cabinet easily transportable. The supply case 34 is provided with a hinged lid 36. Various stationery supplies such as pens, pencils, etc. are received within the supply case 34. A long narrow compartment 30 is provided for the storage of large documents and other materials. The main compartment 29 of the file cabinet 12 is provided with a pair of parallel extending notched divider supports or bars, one of which, is illustrated at 38. A plurality of file dividers 40 are selectively positionable along the notched dividers supports or bars 38. This allows the compartment 29 to be organized as desired. A pair of recessed handles 42 are provided on opposite sides of the file cabinet 12. The body of the file cabinet 12 may be formed from an aluminum alloy material impregnated with various colored pigments, or may be formed from a less expensive material, for example a fiber board material of the type sold under the trademark MASONITE. The interior of the file cabinet 12 may be lined with leather or cloth to give a neat appearance.

Figure 2:
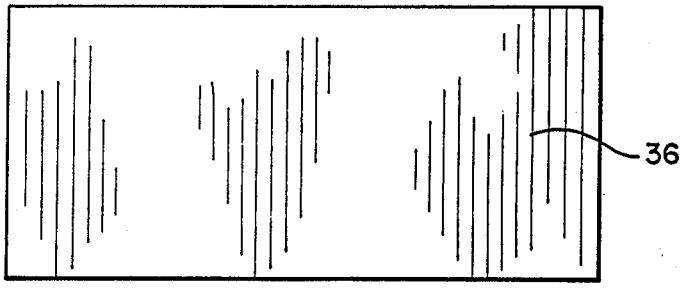
FIG. 2 is a top plan view of the removable supply case of the present invention.

With reference now to FIG. 2, a top view of the lid 36 of the supply case 34 is provided.

Figure 3:
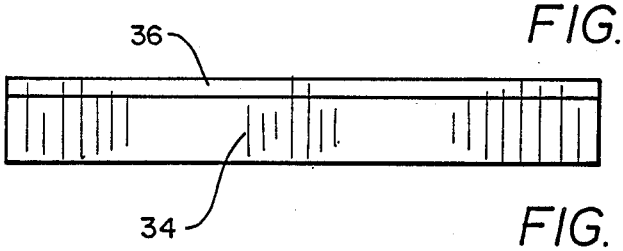
FIG. 3 is a side plan view of the removable supply case of the present invention.

In FIG. 3, a side view of the supply case 34 illustrating the lid 36 is provided.

Figure 4:
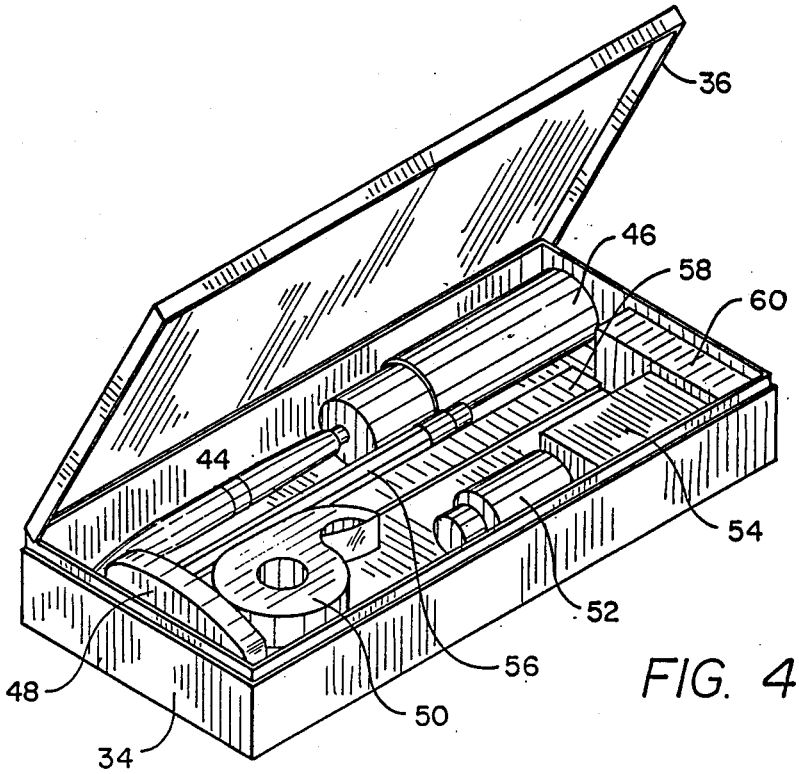
FIG. 4 is a perspective view of the removable supply case of the present invention.

With reference now to FIG. 4, a perspective view illustrating the interior contents of the supply case 34 is provided. The supply case 34 may contain a pen 44, a highlighter 46, a stapler 48, a tape dispenser 50, correction fluid 52, a box of paper clips 54, a pencil 56, a ruler 58 and an eraser 60. Various other conventional stationery items may be substituted, the above description being merely illustrative of the large number of frequently utilized stationery items that may be stored within a relatively small space in the supply case 34.

Figure 5:
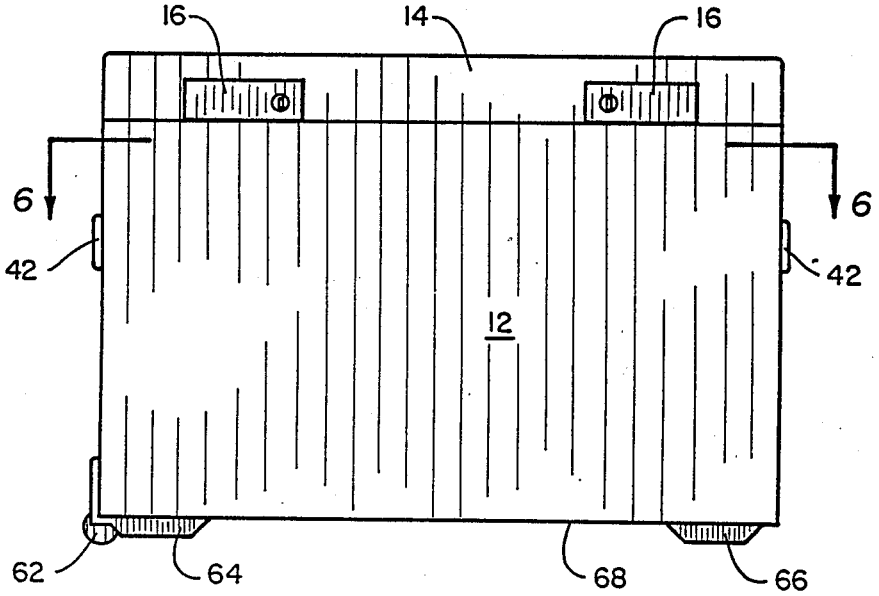
FIG. 5 is a side view of the portable file cabinet of the present invention.

In FIG. 5, a side view of the portable file cabinet 12 is depicted. A pair of conventional suit case type latches 16 serve to secure the lid 14 in a closed position. A pair of recessed handles 42 are provided on opposite sides of the file cabinet 12. A pair of wheels 62 are mounted apart from each other on opposite sides from handle 70 on a bottom surface 68 of the file cabinet 12. A pair of rear supports 64 are positioned adjacent the wheels 62.

A pair of front supports 66 are disposed at an opposite side of the file cabinet 12.

Figure 6:
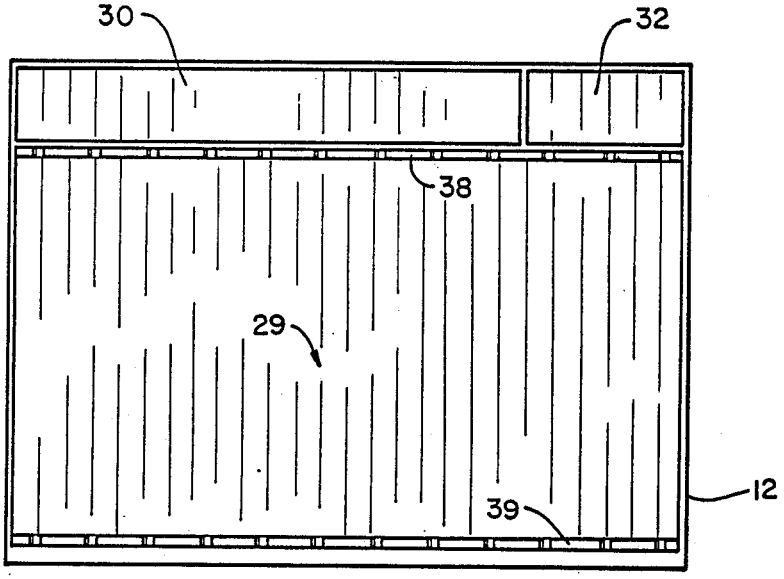
FIG. 6 is a cross sectional view taken along lines 6—6 of FIG. 5, illustrating a top plan view of the interior of the portable file cabinet of the present invention.

In FIG. 6, a cross sectional view taken along line 6—6 of FIG. 5 is illustrated. The main compartment 29 is provided with a pair of spaced notched divider supports or bars 38 and 39.

The narrow elongated compartment 30 is dimensioned for the reception of oversized documents. The compartment 32 removably receives the supply case 34.

Figure 7:
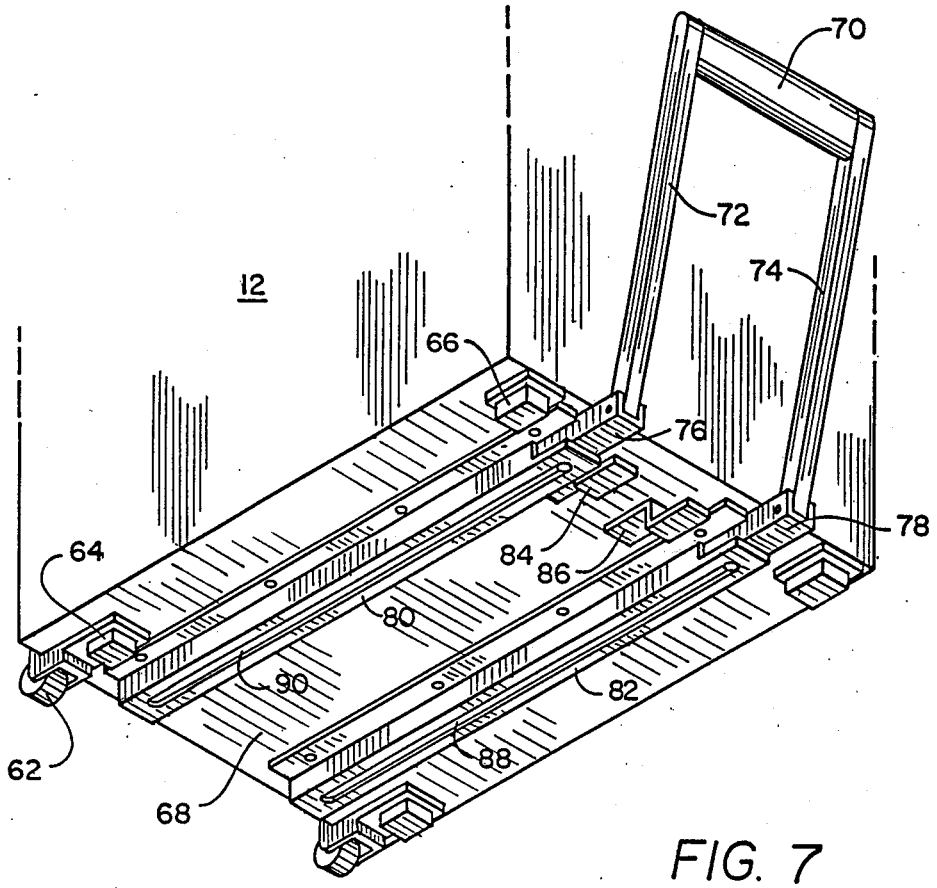
FIG. 7 is a partial perspective view of the portable file cabinet of the present invention, illustrating the wheels, supports and retractable handle mounted on the bottom surface.

With reference now to FIG. 7, a perspective view of the bottom surface 68 of the file cabinet 12 is provided. A handle 70, formed from a padded rubber or plastic material, is mounted between two spaced handle support bars 72 and 74. The handle support bars 72 and 74 are pivotally mounted to slide blocks 76 and 78. The slide blocks 76 and 78 are received in a pair of spaced channel tracks 80 and 82 secured to the bottom surface 68 of the file cabinet 12. A pair of elongated grooves 88 and 90 are formed in the tracks 82 and 80 for the reception of stop pins 92 mounted on the slide blocks 76 and 78. By pivoting the handle 70, the slide blocks 76 and 78 can be retracted into the tracks 80 and 82. The handle 70 is retained in a storage position by reception in a pair of retaining brackets 84 and 86.

Figure 8:
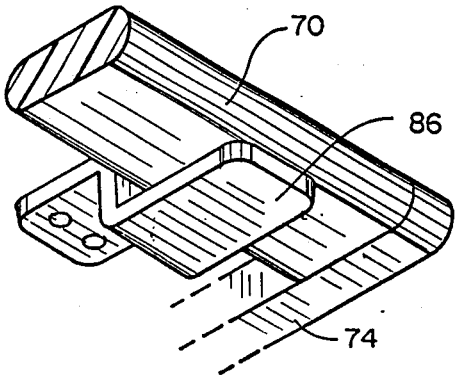
FIG. 8 is a detail view of the latch mechanism of the retractable handle.

As shown in FIG. 8, the handle 70 is held in a retracted position by frictional engagement between the retaining bracket 86 and the bottom surface 68 of the file cabinet 12.

Figure 9:
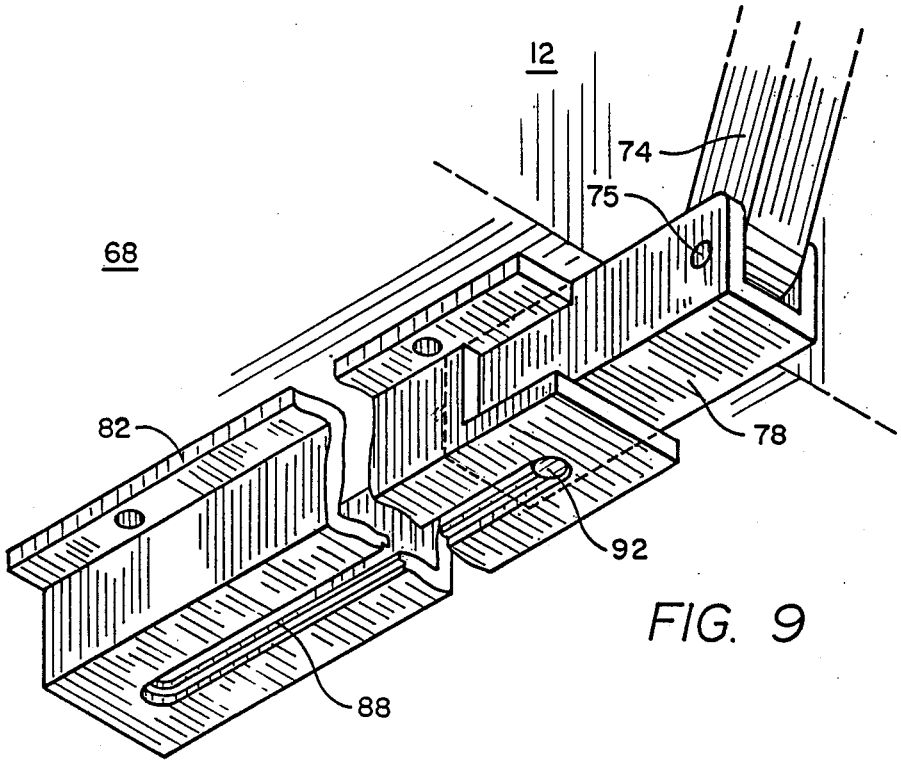
FIG. 9 is a perspective detail view illustrating the mechanism of the retractable handle.

In FIG. 9, a partial perspective detail view, illustrating the retractable handle mounting mechanism, is provided. The handle support bar 74 is secured by a pivot pin 75 to the slide block 78. The slide block 78 is received for sliding movement within the channel track 82. A transversely extending stop pin 92 is rigidly secured to the slide block 78 and is slidably received in the groove 88. This prevents the slide block 78 from being pulled entirely out of the channel track 82.

Figure 10:
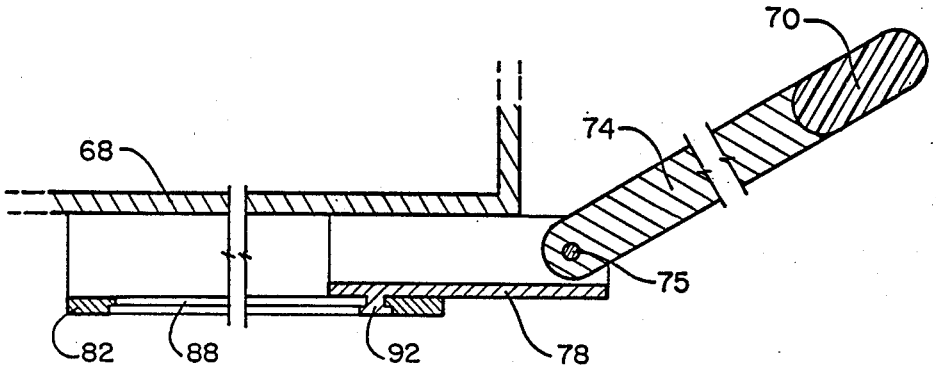
FIG. 10 is a longitudinal cross sectional detail view illustrating the mechanism of the retractable handle.

In FIG. 10, a longitudinal cross sectional view illustrates the stop pin 92 received in the elongated groove 88. By pivoting the handle support bar 74 to a position in which it extends parallel to the bottom surface 68 of the file cabinet 12, the slide block 78 and handle support bar 74 may be slidably inserted into the channel track 82.

Figure 11:
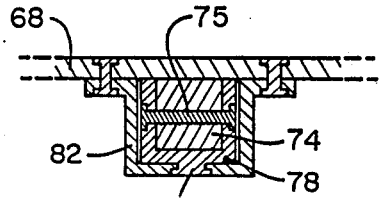
FIG. 11 is a transverse cross sectional view illustrating the mechanism of the retractable handle.

In FIG. 11, a transverse cross sectional view is provided, illustrating the slide block 78 received within the channel track 82.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved portable file, comprising:

a generally rectangular file cabinet;

a hinged lid secured to an open upper end of said cabinet;

a pair of generally rectangular channel tracks extending in spaced parallel relation on a bottom surface of said file cabinet, said channel tracks having respective and openings disposed adjacent a first end of said bottom surface;

a pair of generally rectangular slide blocks mounted for sliding movement in said channel tracks, said slide blocks each having an outer end extendable through a respective one of said channel track end openings;

an elongated groove formed through each of said channel tracks;

a stop pin secured to each of said slide blocks, said stop pins each extending through a respective one of said elongated grooves to retain said slide blocks in said channel tracks;

a pair of handle support bars each having a first end pivotally secured to said outer end of a respective one of said slide blocks;

a handle mounted between said handle support bars, said handle securing said support bars for simultaneous parallel pivotal movement;

at least one handle retaining bracket mounted on said bottom surface of said file cabinet, between said channel tracks adjacent said end openings, said retaining bracket dimensioned to selectively frictionally retain said handle in a retracted position, between said retaining bracket and said bottom surface;

a support pad secured adjacent each corner on said bottom surface for supporting said file cabinet in a stationary position on a horizontal surface; and a pair of wheels secured in spaced aligned relation on said bottom surface, adjacent a second end of said bottom surface opposite said first end, whereby said handle support bars are receivable in said channel tracks with said handle disposed in said retaining bracket in said retracted position and said handle support bars and said handle are movable to extend outwardly and upwardly from said first end of said bottom surface in an extended position to transport said file cabinet on said wheels.

2. The portable file of claim 1, further comprising 1 a t c h means for securing said lid in a closed position.

3. The portable file of claim 1, further comprising e l b o w bracket means for retaining said lid in an open position.

4. The portable file of claim 1, further comprising a pair of multi-fold file holders mounted on an interior surface of said lid.

5. The portable file of claim 4, further comprising s t r a p means for securing said file holders in a closed position.

6. The portable file of claim 1, further comprising a main compartment in said cabinet.

a pair of spaced elongated file divider supports extending along opposite sides of said main compartment, a plurality of aligned pairs of notches provided in said file divider supports; and a plurality of dividers, received in said aligned pairs of notches in said file divider supports, said dividers extending transversely across said main compartment.

7. The portable file of claim 1, further comprising a pair of recessed handles on opposite sides of said file cabinet.

8. The portable file of claim 1, wherein said file cabinet and lid are formed from an aluminum alloy.

9. The portable file of claim 1, wherein said file cabinet and lid are formed from a rigid fiberboard material.

10. A new and improved portable file, comprising:

a generally rectangular file cabinet;

a hinged lid secured to said cabinet;

latch means for securing said lid in a closed position;

elbow bracket means for retaining said lid in an open position;

a pair of multi-fold file holders mounted on an interior surface of said lid;

strap means for securing said file holders in a closed position;

a main compartment in said cabinet;

a pair of spaced elongated file divider supports extending along opposite sides of said main compartment, a plurality of aligned pairs of notches provided in said file divider supports;

a plurality of dividers, received in said aligned pairs of notches in said file divider supports, said dividers extending transversely across said main compartment;

a pair of generally rectangular channel tracks extending in spaced parallel relation on a bottom surface of said file cabinet, said channel tracks having respective end openings disposed adjacent a first end of said bottom surface;

a pair of generally rectangular slide blocks mounted for sliding movement in said channel tracks, said slide blocks each having an outer end extendable through a respective one of said channel track end openings;

an elongated groove formed through each of said channel tracks;

a stop pin secured to each of said slide blocks, said stop pins each extending through a respective one of said elongated grooves to retain said slide blocks in said channel tracks;

a pair of handle support bars each having a first end pivotally secured to said outer end of a respective one of said slide blocks;

a padded resilient handle mounted between said handle support bars, said handle securing said support bars for simultaneous parallel pivotal movement;

at least one handle retaining bracket mounted on said bottom surface of said file cabinet, between said channel tracks adjacent said end openings, said retaining bracket dimensioned to selectively frictionally retain said handle in a retracted position, between said retaining bracket and said bottom surface;

a support pad secured adjacent each corner on said bottom surface for supporting said file cabinet in a stationary position on a horizontal surface; and a pair of wheels secured in spaced aligned relation on said bottom surface, adjacent a second end of said bottom surface opposite said first end, whereby said handle support bars are receivable in said channel tracks with said handle disposed in said retaining bracket in a said retracted position and said handle support bars and said handle are movable to extend outwardly and upwardly from said first end of said bottom surface in an extended position to transport said file cabinet on said wheels.

11. The portable file of claim 10, further comprising a narrow elongated secondary compartment and a third supply case compartment in said file cabinet.

12. The portable file of claim 11, further comprising a removable supply case received in said third supply case compartment.

* * * * *